US009028297B2

(12) United States Patent
Kosuge et al.

(10) Patent No.: US 9,028,297 B2
(45) Date of Patent: May 12, 2015

(54) POLISHING APPARATUS

(71) Applicant: Ebara Corporation, Tokyo (JP)

(72) Inventors: Ryuichi Kosuge, Tokyo (JP); Tadakazu Sone, Tokyo (JP)

(73) Assignee: Ebara Corporation, Tokyo (JP)

( * ) Notice: Subject to any disclaimer, the term of this patent is extended or adjusted under 35 U.S.C. 154(b) by 195 days.

(21) Appl. No.: 13/736,180

(22) Filed: Jan. 8, 2013

(65) Prior Publication Data

US 2013/0210324 A1 Aug. 15, 2013

(30) Foreign Application Priority Data

Jan. 12, 2012 (JP) ..... 2012-3870

(51) Int. Cl.

| | |
|---|---|
| ***B24B 55/04*** | (2006.01) |
| ***B24B 53/007*** | (2006.01) |
| ***B24B 7/22*** | (2006.01) |
| ***B24B 55/00*** | (2006.01) |
| ***B24B 37/04*** | (2012.01) |
| ***B24B 53/017*** | (2012.01) |

(52) U.S. Cl.

CPC ..... *B24B 55/00* (2013.01); *B24B 37/04* (2013.01); *B24B 53/017* (2013.01)

(58) Field of Classification Search

CPC ..... B24B 55/04; B24B 53/00; B24B 53/007; B24B 7/22; B24B 7/228

USPC ..... 451/72, 451, 456, 56, 443

See application file for complete search history.

(56) References Cited

U.S. PATENT DOCUMENTS 6,419,559 B1 * 7/2002 Gurusamy et al. ..... 451/41

FOREIGN PATENT DOCUMENTS

| | | |
|---|---|---|
| JP | 07-171762 | 7/1995 |
| JP | 3043578 | 5/2000 |
| JP | 2008-166709 | 7/2008 |
| WO | 00/18542 | 4/2000 |

* cited by examiner

*Primary Examiner* — Robert Rose

(74) *Attorney, Agent, or Firm* — Wenderoth, Lind & Ponack, L.L.P.

(57) ABSTRACT

The present invention relates to a polishing apparatus for polishing an object to be polished (substrate) such as a semiconductor wafer to a flat mirror finish. The polishing apparatus includes a polishing table configured to support a polishing pad, a polishing head having a top ring configured to press an object to be polished against the polishing pad while the object to be polished is rotated, and a dresser head having a dresser configured to dress the polishing pad. The polishing apparatus has a head cover having a purge gas introducing unit configured to introduce a purge gas into the head cover and an exhausting unit configured to exhaust the interior of the head cover. The pressure in the head cover is set to a pressure level slightly higher than the pressure outside the head cover, and main components of the polishing head are housed in the head cover.

13 Claims, 5 Drawing Sheets

POLISHING APPARATUS

CROSS REFERENCE TO RELATED APPLICATIONS

This document claims priority to Japanese Patent Application Number 2012-3870, filed Jan. 12, 2012, the entire contents of which are hereby incorporated by reference.

BACKGROUND OF THE INVENTION

1. Field of the Invention

The present invention relates to a polishing apparatus, and more particularly to a polishing apparatus for polishing an object to be polished (substrate) such as a semiconductor wafer to a flat mirror finish.

2. Description of the Related Art

As semiconductor devices have become more highly integrated in recent years, circuit interconnections have become finer and distances between these circuit interconnections become smaller. In the case of photolithography which can form interconnections that are at most 0.5 μm wide, it is required that surfaces on which pattern images are to be focused by a stepper should be as flat as possible because the depth of focus of an optical system is relatively small. As a means for planarizing a surface of a semiconductor wafer, a polishing apparatus for performing chemical mechanical polishing (CMP) has been known.

This type of polishing apparatus includes a polishing table having a polishing pad thereon, and a polishing head having a top ring. An object to be polished such as a semiconductor wafer is placed between the polishing table and the top ring. While a polishing liquid (slurry) is being supplied to a polishing surface (surface) of the polishing pad, the object to be polished is pressed against the polishing surface of the polishing pad by the top ring to polish the object to a flat mirror finish.

When the object to be polished is polished, abrasive particles and polishing debris are attached to the polishing surface of the polishing pad, resulting in a change in properties of the polishing pad and deterioration in polishing performance. Therefore, as the objects to be polished are repeatedly polished by the same polishing pad, a polishing rate is lowered and nonuniform polishing action is caused. Thus, in order to regenerate the polishing surface of the polishing pad, the polishing apparatus generally has a dresser head having a dresser disposed adjacent to the polishing table for dressing the polishing pad.

If such polishing apparatus is used in a corrosive atmosphere of chemicals, then a gas of the chemicals enters a cover for enclosing components of the polishing head through clearances in the cover, thereby tending to corrode the components of the polishing head that are made of aluminum, stainless steel, steel, or the like. This holds true for the dresser head having the dresser. The gas of the chemicals also enters a cover for enclosing components of the dresser head, thereby tending to corrode the components of the dresser head.

Further, in a polishing apparatus having an electropneumatic regulator for a top ring, a high-temperature gas of chemicals enters a cover for enclosing the electropneumatic regulator for the top ring, or the temperature inside the cover rises due to the heat from a driving unit such as a top ring rotating motor, causing the electropneumatic regulator for the top ring to suffer temperature drifts which are likely to develop pressure variations in the pneumatic pressure.

There has been proposed a polishing apparatus having a polishing head rotating means for rotating a polishing head (top ring), and the polishing head rotating means is disposed in a hermetically enclosed state, preferably in a positively exhausted state for air circulation to reduce an amount of dust (particles) discharged from the polishing apparatus into ambient atmosphere, as disclosed in Japanese patent No. 3043578. Further, the applicant of the present application has proposed a polishing apparatus including a substrate holding mechanism (polishing head) and a polishing table which are covered by a capsule assembly, and a purge mechanism for introducing, when necessary, a purge gas into a top ring capsule that houses the substrate holding mechanism, in order to prevent a gas generated from a corrosive and toxic processing liquid from being scattered around in the polishing apparatus, as disclosed in Japanese laid-open patent publication No. 2008-166709.

SUMMARY OF THE INVENTION

However, in the conventional polishing apparatus, the corrosion of the components of the polishing head and the dresser head caused by chemicals at the time when the polishing apparatus is used to polish objects to be polished in an atmosphere of chemicals is not considered at all. Therefore, if the polishing apparatus is used in a corrosive atmosphere by chemicals, the components of the polishing head and the dresser head are highly likely to be corroded by the chemicals. Further, in the polishing apparatus having the electropneumatic regulator for the top ring, there has been a strong demand for a reduction in temperature drifts of the electropneumatic regulator for the top ring to minimize pressure variations in the pneumatic pressure.

The present invention has been made in view of the above. It is therefore an object of the present invention to provide a polishing apparatus which can prevent main components of a polishing head and/or main components of a dresser head from being corroded by chemicals even when the polishing apparatus is used in an atmosphere of the chemicals, and which can reduce temperature drifts of an electropneumatic regulator for a top ring to minimize pressure variations in the pneumatic pressure in the apparatus having such electropneumetic regulator for the top ring.

In order to achieve the above object, according to the present invention, there is provided a polishing apparatus comprising: a polishing table configured to support a polishing pad; a polishing head having a top ring configured to press an object to be polished against the polishing pad while the object to be polished is rotated; a dresser head having a dresser configured to dress the polishing pad; and a head cover having a purge gas introducing unit configured to introduce a purge gas into the head cover and an exhausting unit configured to exhaust the interior of the head cover; wherein the pressure in the head cover is set to a pressure level slightly higher than the pressure outside the head cover, and main components of the polishing head are housed in the head cover.

According to the present invention, while the purge gas is being introduced into the head cover which houses the main components of at least one of the polishing head and the dresser head, the interior of the head cover is exhausted to set the pressure in the head cover to a pressure level slightly higher than the pressure outside the head cover. Consequently, even if the polishing apparatus is used in an atmosphere of chemicals, the gas of the chemicals can be prevented from entering the head cover. Further, since the interior of the head cover is exhausted at all times through the exhausting unit, even though the pressure in the head cover is set to a pressure level slightly higher than the pressure outside the head cover, particles in the head cover can be prevented from being discharged to the outside of the head cover through locations other than the exhausting unit. Furthermore, since the temperature in the head cover can be prevented from rising, temperature drifts of an electropneumatic regulator for the top ring housed in the head cover can be reduced to minimize pressure variations in the pneumatic pressure.

The main components of the polishing head include a top ring swing arm, a top ring rotating motor, and a top ring lifting and lowering mechanism. The main components of the dresser head include a main dresser swing arm and a dresser rotating motor.

The pressure of the purge gas introduced into the head cover is preferably in the range of 0.15 to 0.25 MPa and the flow rate of the purge gas is preferably in the range of 40 to 60 L/min.

For example, $N_2$ gas is used as the purge gas and the $N_2$ gas (purge gas) is introduced into the head cover under a pressure of 0.2 MPa and at a flow rate of 50 L/min, and thus the pressure in the head cover can be regulated to a pressure level slightly higher than the pressure outside the head cover. The pressure difference in the slightly higher pressure is preferably in the range of 0.040 to 0.149 MPa.

It is desirable that the head cover is formed into a hollow box composed of a plurality of plate-like members joined together, and hermetic seals are applied to junctions of the respective members. For example, the hermetic seal comprises Norseal having a closed-cell structure.

Since the hermetic seals such as Norseal are applied to the junctions of the respective members to construct the head cover, airtightness of the interior of the head cover can be enhanced.

According to the polishing apparatus of the present invention, even if the polishing apparatus is used in an atmosphere of chemicals, the gas of the chemicals is prevented from entering the head cover, and thus the components of the polishing head or the dresser head can be prevented from being corroded. Further, since the interior of the head cover is exhausted at all times through the exhausting unit, particles in the head cover are prevented from being discharged to the outside of the head cover through locations other than the exhausting unit. Furthermore, temperature drifts of an electropneumatic regulator for the top ring housed in the head cover are reduced to minimize pressure variations in the pneumatic pressure.

DESCRIPTION OF THE PREFERRED EMBODIMENT

Embodiments of the present invention will be described below with reference to drawings.

Figure 1:
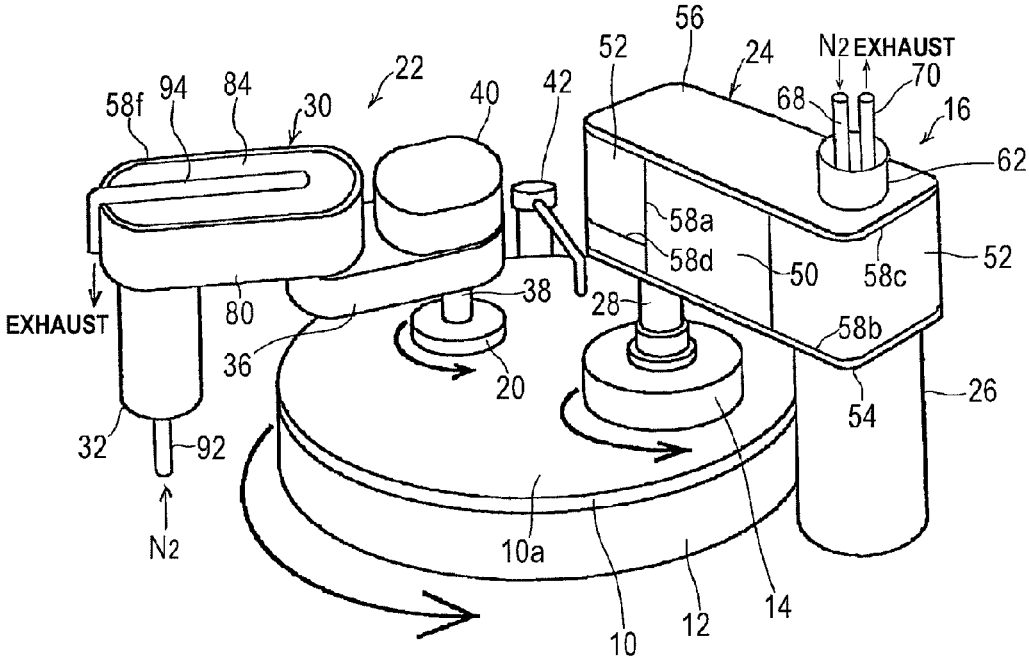
FIG. 1 is a perspective view showing a schematic structure of a polishing apparatus according to an embodiment of the present invention.

FIG. 1 is a perspective view showing a schematic structure of a polishing apparatus according to an embodiment of the present invention. As shown in FIG. 1, the polishing apparatus has a polishing pad 10 having an upper surface serving as a polishing surface 10*a*, a polishing table 12 having an upper surface to which the polishing pad 10 is attached, a polishing head 16 having a top ring 14 for polishing a substrate (object to be polished) such as a semiconductor wafer by holding the substrate in sliding contact with the polishing surface (upper surface) 10*a* of the polishing pad 10, and a dresser head 22 having a dresser 20 for dressing the polishing surface 10*a* of the polishing pad 10. The polishing table 12 is coupled to a motor (not shown), which rotates the polishing table 12 and the polishing pad 10 in a direction indicated by an arrow.

The polishing head 16 has main components housed in a polishing head cover 24, and is connected to an upper end of a rotatable polishing head swing shaft 26 that extends upwardly through a bottom plate of the polishing head cover 24. The top ring 14 is connected to a lower end of a top ring drive shaft 28 that extends downwardly through the bottom plate of the polishing head cover 24. The top ring 14 has a lower surface serving as a substrate holding surface for holding the substrate by vacuum attraction.

The dresser head 22 has main components housed in a dresser head cover 30, and is connected to an upper end of a rotatable dresser head swing shaft 32 that extends upwardly through a bottom plate of the dresser head cover 30. The dresser head 22 has a rotating shaft 34 that extends downwardly through the bottom plate of the dresser head cover 30, and an auxiliary dresser swing arm 36 which has one end connected to the lower end of the rotating shaft 34 and extends horizontally. The auxiliary dresser swing arm 36 has the other end having an auxiliary cover 40 which houses a drive mechanism for vertically moving and rotating a dresser drive shaft 38. The dresser 20 is connected to a lower end of the dresser drive shaft 38.

A liquid supply mechanism 42 is disposed adjacent to the polishing table 12 to supply a polishing liquid and a dressing liquid to the polishing surface 10*a* of the polishing pad 10. The liquid supply mechanism 42 has a plurality of supply nozzles that supply the polishing liquid and the dressing liquid to the polishing surface 10*a* of the polishing pad 10. The liquid supply mechanism 42 serves as both a polishing liquid supply mechanism for supplying the polishing liquid to the polishing pad 10 and a dressing liquid supply mechanism for supplying the dressing liquid (e.g., pure water) to the polishing pad 10. The polishing liquid supply mechanism and the dressing liquid supply mechanism may be provided as separate individual mechanisms.

Figure 2:
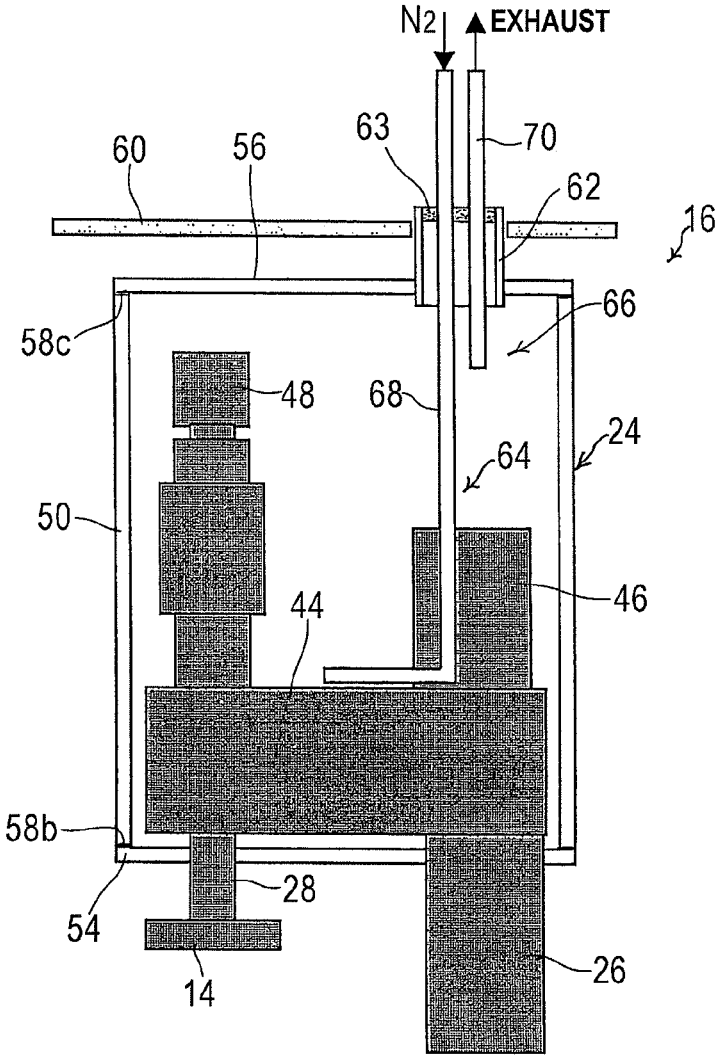
FIG. 2 is a cross-sectional view showing a schematic structure of a polishing head cover and a schematic structure of a polishing head in the polishing apparatus shown in FIG. 1.

As shown in FIG. 2, the polishing head 16 comprises a top ring swing arm 44 which is connected to the upper end of the polishing head swing shaft 26 and swung by rotation of the polishing head swing shaft 26, a top ring rotating motor 46 for rotating the top ring drive shaft 28 through a belt transmitting mechanism (not shown), and a top ring lifting and lowering mechanism 48 comprising an air cylinder or the like for lifting and lowering the top ring drive shaft 28. Thus, the top ring 14 is rotated about the top ring drive shaft 28 in the direction indicated by the arrow in FIG. 1, and is lifted and lowered by the top ring lifting and lowering mechanism 48.

The substrate is polished in the following manner: The substrate to be polished is held on the lower surface of the top ring 14, and the top ring 14 and the polishing table 12 are rotated respectively. In this state, the polishing liquid is supplied to the polishing surface 10*a* of the polishing pad 10, and the substrate is pressed against the polishing surface 10*a* of the polishing pad 10 by the top ring 14. Thus, the surface (lower surface) of the substrate is polished by a mechanical polishing action performed by abrasive particles contained in the polishing liquid and a chemical polishing action performed by the polishing liquid. The polishing head swing shaft 26, which is positioned radially outwardly of the polishing pad 10, is rotated to move the top ring 14 between a polishing position above the polishing pad 10 and a standby position outside the polishing pad 10.

In this embodiment, the polishing head cover 24 is in the form of a hollow box composed of a pair of flat side plates 50, a pair of curved end plates 52, a flat bottom plate 54, and a flat top plate 56. The main components of the polishing head 16 which include the top ring swing arm 44, the top ring rotating motor 46, the top ring lifting and lowering mechanism 48, and the like are housed in the polishing head cover 24. The polishing head swing shaft 26 and the top ring drive shaft 28 extend downwardly through the bottom plate 54.

Figure 3:
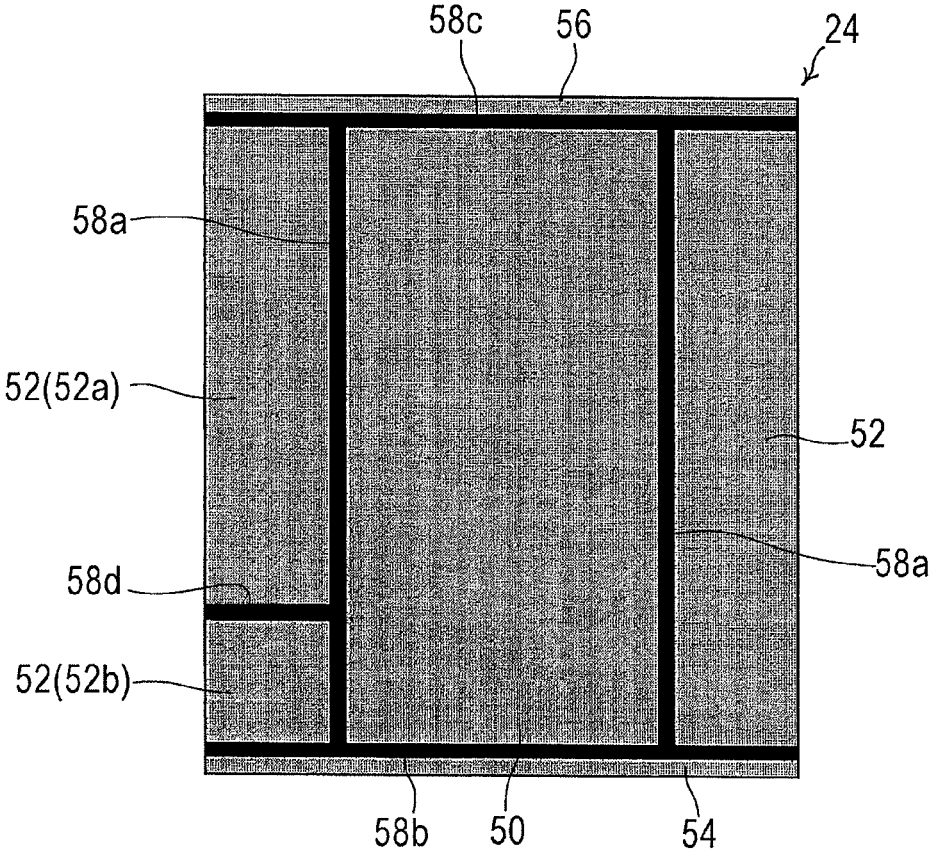
FIG. 3 is a view showing the schematic relationship between components of the polishing head cover and hermetic seals in the polishing apparatus shown in FIG. 1.

As schematically shown in FIG. 3, hermetic seals 58*a*, 58*b*, 58*c* are applied to the junctions between the components of the polishing head cover 24, i.e., the junctions between the side plates 50 and the end plates 52, the junctions between the side and end plates 50, 52 and the bottom plate 54, and the junctions between the side and end plates 50, 52 and the top plate 56, to enhance airtightness of the interior of the polishing head cover 24. In the illustrated embodiment, the hermetic seals 58*a*, 58*b*, 58*c* are made of a sealing material having a closed-cell struture, known as Norseal (registered trademark), which includes polyvinyl chloride as a base material and have a very high sealing capability under low compression. The closed-cell sealing material is attached to and compressed into the respective junctions to enhance airtightness of the polishing head cover 24.

In this embodiment, one of the end plates 52 comprises an upper end plate 52*a* and a lower end plate 52*b* which are joined to each other at a junction. A hermetic seal 58*d* made of Norseal, for example, is also applied to the junction between the upper end plate 52*a* and the lower end plate 52*b*.

The polishing head cover 24 is suspended by a tubular support 62 mounted on a ceiling wall 60 for forming an installation space in which the polishing apparatus is installed. The tubular support 62 has a lower end extending into the polishing head cover 24 through a through-hole formed in the top plate 56 of the polishing head cover 24, and an upper end extending into a space above the ceiling wall 60 through a through-hole formed in the ceiling wall 60. The tubular support 62 has an upper end filled with a filler 63. An electropneumatic regulator (not shown) for the top ring is housed in the polishing head cover 24.

Further, the polishing head cover 24 houses therein a purge gas introducing unit 64 for introducing a purge gas such as $N_2$ gas into the polishing head cover 24, and an exhausting unit 66 for exhausting the interior of the polishing head cover 24. The purge gas introducing unit 64 has a purge gas introducing pipe 68 which extends through the tubular support 62 into a lower region of the polishing head cover 24 and is then bent at a right angle. The exhausting unit 66 has an exhausting pipe 70 which extends through the tubular support 62 into the polishing head cover 24.

Figure 4:
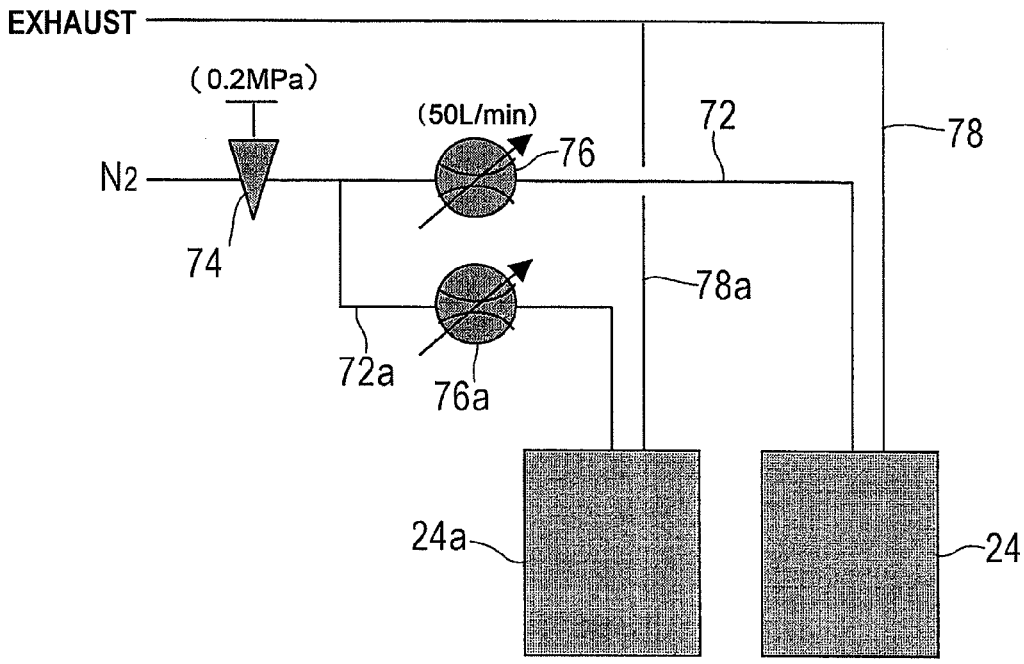
FIG. 4 is a diagram showing the relationship between a purge gas introducing line, an exhausting line, and the polishing head cover.

The purge gas introducing pipe 68 is connected to a purge gas introducing line 72 shown in FIG. 4. A regulator 74 for regulating the pressure of the purge gas such as $N_2$ gas that flows through the purge gas introducing line 72, and a flowmeter (mass flow controller) 76 for measuring and regulating the flow rate of the purge gas such as $N_2$ gas that flows through the purge gas introducing line 72 are provided in the purge gas introducing line 72. On the other hand, the exhausting pipe 70 is connected to an exhausting line 78 shown in FIG. 4.

The internal pressure of the polishing head cover 24 is set to a pressure level slightly higher than the external pressure of the polishing head cover 24. Specifically, while the purge gas such as $N_2$ gas is being introduced at a predetermined flow rate under a predetermined pressure through the purge gas introducing unit 64 into the polishing head cover 24, the interior of the polishing head cover 24 is exhausted through the exhausting unit 66 in order to keep the pressure in the polishing head cover 24 at a pressure level slightly higher than the pressure outside the polishing head cover 24.

The pressure of the purge gas introduced into the polishing head cover 24 is in the range of 0.15 to 0.25 MPa, for example, and the flow rate of the purge gas is in the range of 40 to 60 L/min, for example. For example, when $N_2$ gas (purge gas) is introduced into the polishing head cover 24 under a pressure of 0.2 MPa and at a flow rate of 50 L/min, the internal pressure of the polishing head cover 24 is regulated to a pressure level slightly higher than the external pressure of the polishing head cover 24. The temperature of the purge gas is a room temperature, for example, 20° C.

Since the internal pressure of the polishing head cover 24 is set to a pressure level slightly higher than the external pressure of the polishing head cover 24, even if the polishing apparatus is used in an atmosphere of chemicals, the gas of the chemicals is prevented from entering the polishing head cover 24. Thus, the components of the polishing head 16 can be prevented from being corroded by the gas of the chemicals. Further, since the interior of the polishing head cover 24 is exhausted to the outside at all times through the exhausting unit 66, even though the pressure in the polishing head cover 24 is set to a pressure level slightly higher than the pressure outside the polishing head cover 24, particles in the polishing head cover 24 are prevented from being discharged to the outside of the polishing head cover 24 through locations other than the exhausting unit 66. In the illustrated embodiment, those particles in the polishing head cover 24 can be discharged through the exhausting line 78 to the outside of the space in which the polishing apparatus is installed. Furthermore, a heated atmosphere from a driving unit including the top ring rotating motor 46 and the like in the polishing head cover 24 is replaced with the purge gas having a constant temperature (room temperature) lower than the heated atmosphere. Therefore, the internal temperature of the polishing head cover 24 can be prevented from rising, and thus temperature drifts of the electropneumatic regulator for the top ring housed in the polishing head cover 24 can be reduced to minimize pressure variations in the pneumatic pressure. The internal pressure of the polishing head cover 24 is set to a pressure level slightly higher than the external pressure of the polishing head cover 24, i.e., the pressure in the polishing head cover 24 is not set to an unnecessarily high pressure level, because the pressure in the polishing head cover 24 may be just high enough to prevent the gas of the chemicals from entering the polishing head cover 24. For example, the main components of the polishing head 16 and the polishing head cover 24 should not be adversely affected by the unnecessarily high pressure in the polishing head cover 24, and wasteful energy should not be consumed.

If the polishing apparatus additionally has a polishing head cover 24*a* shown in FIG. 4 which is structurally identical to the polishing head cover 24, then a flowmeter 76*a* is provided in a branch line 72*a* that is branched from the purge gas introducing line 72 between the regulator 74 and the flowmeter (mass flow controller) 76, and a purge gas introducing pipe of the polishing head cover 24*a* is connected to the branch line 72*a*. Further, an exhausting line 78*a* extending from an exhausting pipe of the polishing head cover 24*a* merges into the exhausting line 78 extending from the exhausting pipe 70 of the polishing head cover 24.

Figure 5:
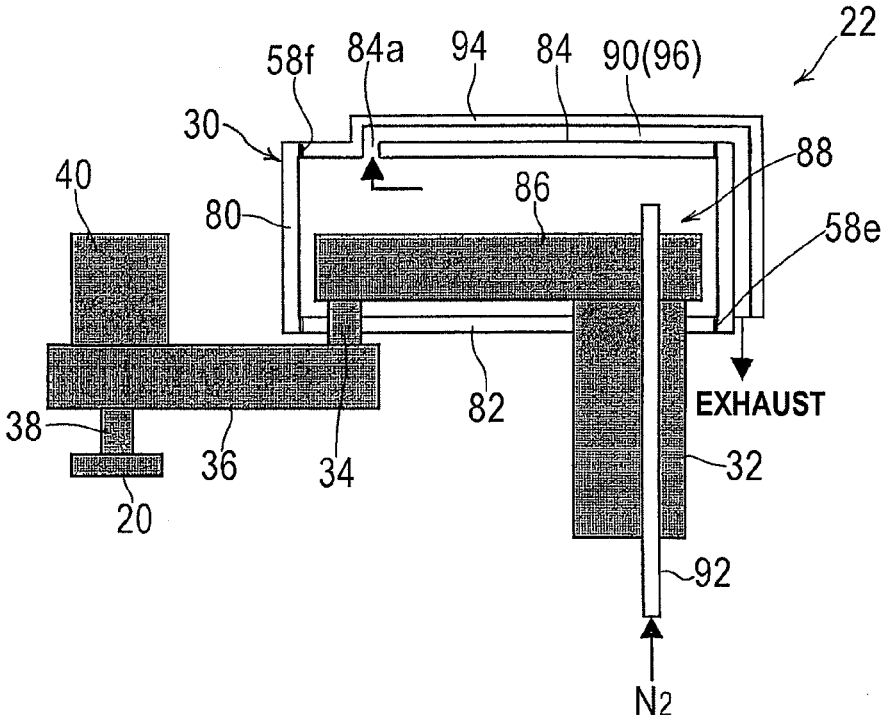
FIG. 5 is a cross-sectional view showing a schematic structure of a dresser head cover and a schematic structure of a dressing head in the polishing apparatus shown in FIG. 1.

As shown in FIG. 5, as with the above polishing head cover 24, the dresser head cover 30 is in the form of a hollow box composed of a curved side plate 80 of a thin-walled hollow cylindrical shape, a flat bottom plate 82, and a flat top plate 84. Hermetic seals 58*e*, 58*f* such as Norseal are applied to the junction between the side plate 80 and the bottom plate 82 and the junction between the side plate 80 and the top plate 84. As with the above polishing head cover 24, a pair of flat side plates may be used and a pair of end plates may be joined to the respective side plates to form a cylindrical shape, instead of the curved side plate 80 of a thin-walled cylindrical shape. The main components of the dresser head 22, which include a main dresser swing arm 86 and a dresser rotating motor (not shown) for rotating the rotating shaft 34 through a belt transmitting mechanism (not shown), are housed in the dresser head cover 30. The dresser head swing shaft 32 and the rotating shaft 34 extend downwardly through the bottom plate 82.

When the polishing surface 10*a* of the polishing pad 10 is dressed, the dresser head swing shaft 32 is rotated to swing the main dresser swing arm 86 from a retracted position to a dressing position. Then, the dresser 20 is rotated in the direction indicated by the arrow in FIG. 1 and is lowered by the drive mechanism housed in the auxiliary cover 40 to bring the dressing surface of the dresser 20 into sliding contact with the polishing surface 10*a* of the polishing pad 10. In this state, the dresser rotating motor housed in the dresser head cover 30 is energized to rotate its output shaft alternately in forward and reverse directions, thereby rotating the rotating shaft 34 alternately in forward and reverse directions. Thus, the auxiliary dresser swing arm 36 is swung in a reciprocating manner to move the dresser 20 back and forth in substantially radial direction of the polishing pad 10. By moving (swinging) of the rotating dresser 20, polishing debris and the like attached to the polishing surface 10*a* of the polishing pad 10 are removed and the polishing surface 10*a* is regenerated. While the polishing surface 10*a* is being dressed, the liquid supply mechanism 42 supplies the dressing liquid (for example, pure water) to the polishing surface 10*a* of the polishing pad 10.

The dress head cover 30 also houses therein a purge gas introducing unit 88 for introducing a purge gas such as $N_2$ gas into the dresser head cover 30, and an exhausting unit 90 for exhausting the interior of the dresser head cover 30. The purge gas introducing unit 88 has a purge gas introducing pipe 92 which extends upwardly through the dresser head swing shaft 32 into a region of the dresser head cover 30 above the main dresser swing arm 86. The purge gas introducing pipe 92 is connected to the purge gas introducing line 72 having the regulator 74 and the flowmeter (mass flow controller) 76 shown in FIG. 4. In this embodiment, the exhausting unit 90 comprises an exhausting passage 96 which communicates with a through-hole 84*a* formed in the top plate 84 and is formed between the dresser head cover 30 and a half pipe 94 mounted on the dresser head cover 30. The exhausting passage 96 extends horizontally above the top plate 84 and along the length direction of the top plate 84 to the side plate 80, and then extends downwardly along the side plate 80 to a lower portion of the side plate 80.

The internal pressure of the dresser head cover 30 is set to a pressure level slightly higher than the external pressure of the dresser head cover 30. Specifically, while the purge gas such as $N_2$ gas is being introduced at a predetermined flow rate under a predetermined pressure through the purge gas introducing unit 88 into the dresser head cover 30, the interior of the dresser head cover 30 is exhausted through the exhausting unit 90 in order to keep the internal pressure of the dresser head cover 30 at a pressure level slightly higher than the external pressure of the dresser head cover 30.

Since the pressure in the dresser head cover 30 is set to a pressure level slightly higher than the pressure outside the dresser head cover 30, as with the above polishing head cover 24, even if the polishing apparatus is used in an atmosphere of chemicals, the gas of the chemicals is prevented from entering the dresser head cover 30. Thus, the components of the dresser head can be prevented from being corroded. Further, since the interior of the dresser head cover 30 is exhausted to the outside at all times through the exhausting unit 90, even though the pressure in the dresser head cover 30 is set to a pressure level slightly higher than the pressure outside the dresser head cover 30, particles in the dresser head cover 30 are prevented from being discharged to the outside of the dressing head cover 30 through locations other than the exhausting unit 90. In the illustrated embodiment, those particles in the dresser head cover 30 are discharged to a region away from the polishing head 16 where they will not adversely affect the polishing process. Further, in this embodiment, the exhausting unit 90 has its outlet port positioned outside the polishing table 12. Therefore, the particles discharged from the outlet port of the exhausting unit 90 are led to the location (location outside the surface of the polishing table 12 for polishing) where the polishing process is not affected.

In the above embodiments, the head covers are provided on both the polishing head 16 and the dresser head 22. However, the head cover may be provided on either one of the polishing head 16 and the dresser head 22.

The above embodiments are described for the purpose of practicing the present invention by a person with ordinary skill in the art to which the invention pertains. Although preferred embodiments have been described in detail above, it should be understood that the present invention is not limited to the illustrated embodiments, but many changes and modifications can be made therein without departing from the appended claims.

What is claimed is:

1. A polishing apparatus comprising:

a polishing table configured to support a polishing pad;

a polishing head having a top ring configured to press an object to be polished against the polishing pad while the object to be polished is rotated;

a dresser head having a dresser configured to dress the polishing pad; and a head cover having a purge gas introducing unit configured to introduce a purge gas into the head cover and an exhausting unit configured to exhaust an interior of the head cover;

wherein a pressure in the head cover is set to a pressure level slightly higher than a pressure outside the head cover, and at least a part of a drive shaft of the top ring is housed in the head cover.

2. The polishing apparatus according to claim 1, wherein a pressure of the purge gas introduced into the head cover is in the range of 0.15 to 0.25 MPa and a flow rate of the purge gas is in the range of 40 to 60 L/min.

3. The polishing apparatus according to claim 1, wherein the head cover is formed into a hollow box comprising a plurality of plate-shaped members joined together, and hermetic seals are applied to junctions of the respective plate-shaped members.

4. The polishing apparatus according to claim 3, wherein the hermetic seal comprises Norseal.

5. The polishing apparatus according to claim 1, wherein a pressure difference in the slightly higher pressure is in the range of 0.040 to 0.149 MPa.

6. The polishing apparatus according to claim 1, wherein a top ring swing arm, a top ring rotating motor, and a top ring lifting and lowering mechanism are housed in the head cover.

7. The polishing apparatus according to claim 1, wherein at least a dresser rotating motor is housed in a head cover.

8. A polishing apparatus comprising:

a polishing table configured to support a polishing pad;

a polishing head having a top ring configured to press an object to be polished against the polishing pad while the object to be polished is rotated;

a dresser head having a dresser configured to dress the polishing pad; and a head cover having a purge gas introducing unit configured to introduce a purge gas into the head cover and an exhausting unit configured to exhaust an interior of the head cover;

wherein a pressure in the head cover is set to a pressure level slightly higher than a pressure outside the head cover, and at least a dresser rotating motor is housed in the head cover.

9. The polishing apparatus according to claim 8, wherein a pressure of the purge gas introduced into the head cover is in the range of 0.15 to 0.25 MPa and a flow rate of the purge gas is in the range of 40 to 60 L/min.

10. The polishing apparatus according to claim 8, wherein the head cover is formed into a hollow box comprising of a plurality of plate-shaped members joined together, and hermetic seals are applied to junctions of the respective plate-shaped members.

11. The polishing apparatus according to claim 10, wherein the hermetic seal comprises Norseal.

12. The polishing apparatus according to claim 8, wherein a pressure difference in the slightly higher pressure is in the range of 0.040 to 0.149 MPa.

13. The polishing apparatus according to claim 8, wherein a main dresser swing arm is housed in the head cover.

* * * * *